US008487479B2

(12) United States Patent
Cook et al.

(10) Patent No.: US 8,487,479 B2
(45) Date of Patent: Jul. 16, 2013

(54) FERRITE ANTENNAS FOR WIRELESS POWER TRANSFER

(75) Inventors: Nigel P. Cook, El Cajon, CA (US); Peter Schwaninger, Hombrechtikon (CH); Hanspeter Widmer, Wohlenschwil (CH)

(73) Assignee: QUALCOMM Incorporated, San Diego, CA (US)

( * ) Notice: Subject to any disclaimer, the term of this patent is extended or adjusted under 35 U.S.C. 154(b) by 369 days.

(21) Appl. No.: 12/391,054

(22) Filed: Feb. 23, 2009

(65) Prior Publication Data

US 2009/0224608 A1 Sep. 10, 2009

Related U.S. Application Data

(60) Provisional application No. 61/030,987, filed on Feb. 24, 2008.

(51) Int. Cl.

| | |
|---|---|
| ***H01F 37/00*** | (2006.01) |
| ***H01F 27/02*** | (2006.01) |
| ***H01Q 7/08*** | (2006.01) |

(52) U.S. Cl.

USPC ..... 307/104; 320/108; 333/119; 343/788; 455/193.3

(58) Field of Classification Search

None

See application file for complete search history.

(56) References Cited

U.S. PATENT DOCUMENTS

| | | | | |
|---|---|---|---|---|
| 4,117,493 | A * | 9/1978 | Altmayer | 343/750 |
| 4,712,112 | A * | 12/1987 | Carr | 343/788 |
| 6,028,413 | A * | 2/2000 | Brockmann | 320/108 |
| 6,100,663 | A * | 8/2000 | Boys et al. | 320/108 |
| 6,118,249 | A * | 9/2000 | Brockmann et al. | 320/108 |
| 6,229,270 | B1 * | 5/2001 | Stephenson et al. | 315/291 |
| 7,825,543 | B2 | 11/2010 | Karalis et al. | |
| 8,063,844 | B1 * | 11/2011 | Pease | 343/788 |
| 2002/0003503 | A1 * | 1/2002 | Justice | 343/788 |
| 2004/0263282 | A1 * | 12/2004 | Kaku et al. | 333/119 |
| 2005/0127867 | A1 | 6/2005 | Calhoon et al. | 320/108 |
| 2005/0131495 | A1 | 6/2005 | Parramon et al. | 607/61 |
| 2007/0222542 | A1 | 9/2007 | Joannopolous | |
| 2007/0222695 | A1 * | 9/2007 | Davis | 343/788 |

(Continued)

FOREIGN PATENT DOCUMENTS

| | | | |
|---|---|---|---|
| EP | 242717 | * | 10/1987 |
| JP | 2000307238 | * | 11/2000 |
| WO | WO 2005/106902 A1 | * | 11/2005 |
| WO | WO 2005/124962 A1 | * | 12/2006 |

OTHER PUBLICATIONS

WO 2008139216 to Ely et al., Oct. 28, 1987, G04C 11_02.*

(Continued)

*Primary Examiner* — Hal Kaplan

(74) *Attorney, Agent, or Firm* — Knobbe Martens Olson & Bear, LLP

(57) ABSTRACT

This disclosure provides systems, methods and apparatus for wireless power transfer using resonant ferrite antennas to transmit and receive power. Ferrite structures concentrate magnetic flux lines into the structure, thereby creating a magnetic path and field with less interference and eddy current losses than in device electronics, thereby improving the efficiency of magnetic power distribution. The disclosure describes tuning the resonance frequency by mechanically adjusting the position of the coil on the rod. The ferrite rod antennas described herein may be used to transfer power to handheld communication devices.

29 Claims, 5 Drawing Sheets

U.S. PATENT DOCUMENTS

| | | | | |
|---|---|---|---|---|
| 2007/0267918 | A1* | 11/2007 | Gyland | 307/104 |
| 2008/0191897 | A1 | 8/2008 | McCollough | 340/625.22 |
| 2009/0179502 | A1* | 7/2009 | Cook et al. | 307/104 |

OTHER PUBLICATIONS

"Wireless Non-Radiative Energy Transfer", MIT paper, publication and date unknown, believed to be 2007.

"Efficient wireless non-radiative mid-range energy transfer", MITpaper, publication and date unknown, believed to be 2007.

"Wireless Power Transfer via Strongly Coupled Magnetic Resonances", Kurs et al, Science Express, Jun. 7, 2007.

"Wireless Power Transfer via Strongly Coupled Magnetic Resonances", Kurs et al, scimag.org, Jul. 6, 2007.

* cited by examiner

FERRITE ANTENNAS FOR WIRELESS POWER TRANSFER

This application claims priority from provisional application No. 61/030,987, filed Feb. 24, 2008, the entire contents of which disclosure is herewith incorporated by reference.

BACKGROUND

Our previous applications and provisional applications, including, but not limited to, U.S. patent application Ser. No. 12/018,069, filed Jan. 22, 2008, entitled "Wireless Apparatus and Methods", the disclosure of which is herewith incorporated by reference, describe wireless transfer of power. The transmit and receiving antennas are preferably resonant antennas, which are substantially resonant, e.g., within 10% of resonance, 15% of resonance, or 20% of resonance. The antenna is preferably of a small size to allow it to fit into a mobile, handheld device where the available space for the antenna may be limited. An embodiment describes a high efficiency antenna for the specific characteristics and environment for the power being transmitted and received. Antenna theory suggests that a highly efficient but small antenna will typically have a narrow band of frequencies over which it will be efficient. The special antenna described herein may be particularly useful for this kind of power transfer.

One embodiment uses an efficient power transfer between two antennas by storing energy in the near field of the transmitting antenna, rather than sending the energy into free space in the form of a travelling electromagnetic wave. This embodiment increases the quality factor (Q) of the antennas. This can reduce radiation resistance ($R_r$) and loss resistance.

In one embodiment, two high-Q antennas are placed such that they react similarly to a loosely coupled transformer, with one antenna inducing power into the other.

The antennas preferably have Qs that are greater than 200, although the receive antenna may have a lower Q caused by integration and damping.

SUMMARY

The present application describes antennas for wireless power transfer. Various implementations of systems, methods and devices within the scope of the appended claims each have several aspects, no single one of which is solely responsible for the desirable attributes described herein.

Another aspect of the disclosure is a device for wireless power transfer. The device comprises a housing. The device further comprises a ferrite antenna, supported by the housing. The ferrite antenna comprises a ferrite rod, a first coil connected to a capacitor, and a second coil physically unconnected to first coil. A position of at least one of the first coil and the second coil are adjustable with respect to the ferrite rod. The device further comprises a circuit coupled to the second coil. The circuit is configured to receive power from the second coil, and transfer the received power to a device within the housing.

One aspect of the disclosure is a method receiving power via a wireless field with a ferrite antenna. The ferrite antenna includes a ferrite rod, a first coil, and a second coil physically unconnected to the first coil. The method comprises receiving power via the wireless field with the first coil. The method further comprises transferring the received power through the ferrite rod. The method further comprises moving a position of at least one of the first coil and the second coil with respect to the ferrite rod so as to tune the ferrite antenna. The method further comprises receiving, at the second coil, the transferred power. The method further comprises powering a device using the power received at the second coil.

Another aspect of the disclosure is device for wireless power transfer. The device comprises means for receiving power via a wireless field, the means for receiving power electrically coupled to a ferrite rod and a first coil. The device also comprises means for adjusting power reception. The means for adjusting power reception comprises means for moving a position of at least the means for receiving. The position of at least the means for receiving is adjustable with respect to the ferrite rod. The device also comprises means for transferring the received power to an electronic device. The means for transferring the received power is electrically coupled to the ferrite rod and physically unconnected to the means for receiving power via the wireless field.

Another aspect of the disclosure is a device for wireless power transfer. The device comprises a housing. The device further comprises a ferrite antenna, supported by the housing. The ferrite antenna comprises a first coil and a second coil, said first coil being connected to a capacitor. A position of at least one of said first coil and said second coil is adjustable with respect to the ferrite antenna. The device further comprises a tuning circuit coupled to the first coil and the second coil. The first coil is connected to the second coil through the tuning circuit. The device further comprises a receiving circuit coupled to the second coil. The receiving circuit is configured to receive power from the second coil and transfer received power to a device within the housing.

Another aspect of the disclosure is a method of receiving power via a wireless field with a ferrite antenna. The ferrite antenna includes a ferrite rod, a first coil, a second coil, and a tuning circuit coupled to the first coil and the second coil. The method comprises receiving power via the wireless field with the first coil. The method also comprises transferring the received power through the ferrite rod. The method further comprises receiving, at the second coil, the transferred power. The method further comprises powering a device using the power received at the second coil. The method further comprises tuning the ferrite antenna based on a power received by the device.

Another aspect of the disclosure is a device including a ferrite antenna. The device comprises means for receiving power via a wireless field, the means for receiving power electrically coupled to a ferrite rod. The device also comprises means for transferring the received power to an electronic device, the means for transferring the received power being electrically coupled to the ferrite rod. The device also comprises means for tuning the ferrite antenna based on power received by the electronic device.

DETAILED DESCRIPTION

Figure 1:
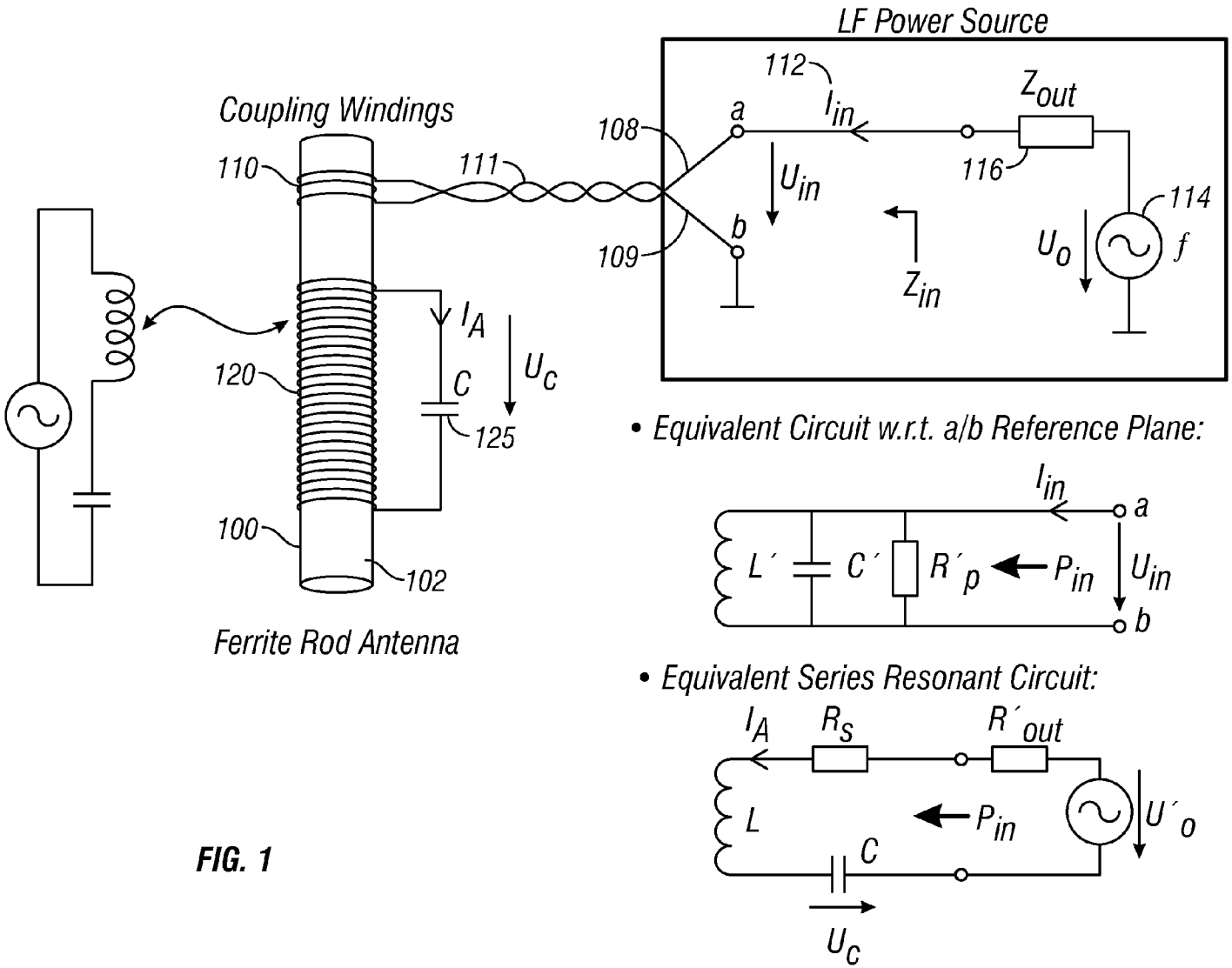
FIG. 1 shows a block diagram with equivalent circuits.

An embodiment uses ferrites in antennas for transmission and reception of magnetic flux used as wireless power. For example, ferrite materials usually include ceramics formed of MO—$Fe_2O_3$, where MO is a combination of divalent metals such as zinc, nickel, manganese and copper oxides. Common ferrites may include MnZn, NiZn and other Ni based ferrites.

Ferrite structures concentrate magnetic flux lines into the structure, thereby creating a magnetic path/field with less interference and eddy current losses in device electronics. This in essence sucks in the magnetic flux lines, thereby improving the efficiency of the magnetic power distribution. An embodiment describes a ferrite rod-shaped antennas. These may provide compact solutions that are easy to integrate into certain kinds of packaging.

The resonance frequency of Ferrite rod antennas may be easier to tune. In one embodiment, the tuning may be carried out by mechanically adjusting the position of the coil on the rod.

However, Ferrite rod antennas may suffer from Q degradation at higher magnetic field strengths (higher receive power levels) due to increasing hysteresis losses in Ferrite material. The present application describes use of special ferrite antennas to carry out wireless transfer of power.

The inventors realized that hysteresis losses in ferrite material may occur at higher power receive levels and higher magnetic field strengths. In addition, increasing the magnetic field strength may actually shift the resonance frequency, especially in certain materials where there are nonlinear B-H characteristics in the ferrites. In addition, harmonics emissions can be generated due to inherent nonlinearity. This nonlinearity becomes more important at lower Q factors.

One aspect of the present system is to compare the performance of these antennas, at different power levels and other different characteristics. By doing this, information about the way these materials operate in different characteristics is analyzed.

Ferrite Rod materials are normally used in communication receiver applications at small signal levels such as at or below 1 mW. No one has suggested using these materials at large levels, e.g. up to 2 W. In order to analyze the characteristics of these materials, measurement values and techniques are described herein. According to one embodiment, the measurement may be carried out by using the antenna as a transmit antenna, and assuming reciprocity as a receiving antenna. The tests increase the voltage and the current, and determine the values of the result.

According to one embodiment, the Q value is used to determine a limit for the amount of power applied.

According to one embodiment, the characteristics of a ferrite Rod antenna are evaluated based on the following parameters

- Q-factor
- Resonance frequency
- Voltage across antenna coil
- Antenna current
- Inductance of antenna coil
- Equivalent permeability of rod
- Equivalent series resistance
- Magnetic inductance in Ferrite rod
- Measurement of tuning range can be achieved by mechanically tuning a ferrite rod.

FIG. 1 illustrates the ferrite Rod antenna 100 under test, where the system is formed of a ferrite Rod 102, on which is wound two different sets of windings. The coupling windings 110 are connected to the electronic circuitry 112. In this embodiment, the electronic circuitry may be transmitting circuitry, however it should be understood that the electronic circuitry can alternately be receiving circuitry. Accordingly, the circuitry 112 is referred to herein as power circuitry. The power circuitry 112 is formed of an AC part, for example an AC generator 114, with a matching impedance 116. The matching impedance 116 is connected to a first wire 108 of the twisted-pair 111. The second wire 109 of the twisted-pair 111 goes to ground. The two wires 108, 109 are collectively connected to a coupling windings 110. Coupling winding 110 is located at a 1st place on the ferrite Rod 100. The coupling winding 110 is completely separated from the main winding 120. Moreover, the number of windings of the coupling winding 110 may be ⅕ to 1/10 the number of windings of the main winding 120. The important part is to induce magnetic flux into the ferrite Rod, without having the resulting impedance corresponding to the induced magnetic flux changed by any external characteristics.

The main winding 120 is also in parallel with a main capacitor 125.

A number of different values within the FIG. 1 embodiment may be measured. For example, these values may include:

| | | |
|---|---|---|
| $U_0$: | Source voltage (e.m.f.) of LF power source | [V] |
| $Z_{out}$: | Output (source) impedance of LF power source | [Ω] |
| $U_{in}$: | Input voltage measured at antenna terminals a/b | [V] |
| $I_{in}$: | Input current measured at antenna terminals a/b | [A] |
| $Z_{in}$: | Input impedance measured at antenna terminals a/b | [Ω] |
| $I_A$: | Antenna current (r.m.s.) | [A] |
| $U_c$: | Voltage across antenna capacitance (r.m.s.) | [V] |
| $P_{in}$: | Antenna input power | [W] |
| L: | Equivalent inductance of Ferrite rod antenna (includes all reactive components except C) | [H] |
| C: | Capacitance required to achieve resonance frequency | [F] |
| $R_s$: | Equivalent series resistance of Ferrite rod antenna (includes all losses except source resistance) | [Ω] |
| $U_0'$: | Source voltage transformed into equivalent series circuit | [V] |
| $R_{out}'$: | Source resistance transformed into equivalent series circuit | [Ω] |
| $Q_{UL}$: | Unloaded Q-factor | |
| $\mu_{rod}$: | Effective relative permeability of Ferrite rod | |
| $B_{rod}$: | Computed magnetic flux density (induction) in Ferrite rod | [T] |
| N: | Number of turns | |
| $A_{Fe}$: | Ferrite cross sectional area | [$m^2$] |

The different characteristics can also be determined from these values, as follows:

2.2.2.2 Equations

Resonance Frequency:

$$f_{res} = \frac{1}{2\pi\sqrt{L \cdot C}} \qquad \text{Equation 2-1}$$

Unloaded Q-Factor:

$$Q_{UL} = \frac{1}{R_s} \cdot \sqrt{\frac{L}{C}} = \frac{2\pi f L}{R_s} \qquad \text{Equation 2-2}$$

$$Q_{UL} = \frac{2\pi \cdot f \cdot C \cdot U_c^2}{P_{in}}$$

Input Power:

$$P_{in} = \mathrm{Re}\{U_{in} \cdot I_{in}\} \qquad \text{Equation 2-3}$$

Effective Relative Permeability of Ferrite Rod $$\mu_{rod} = \frac{L}{L_{air}} \qquad \text{Equation 2-4}$$

Magnetic Flux Density (Inductance) in Ferrite Rod:

$$B_{rod} = \frac{U_C}{\pi \cdot \sqrt{2} \cdot N \cdot A_{Fe} \cdot f} \qquad \text{Equation 2-5}$$

Figure 2:
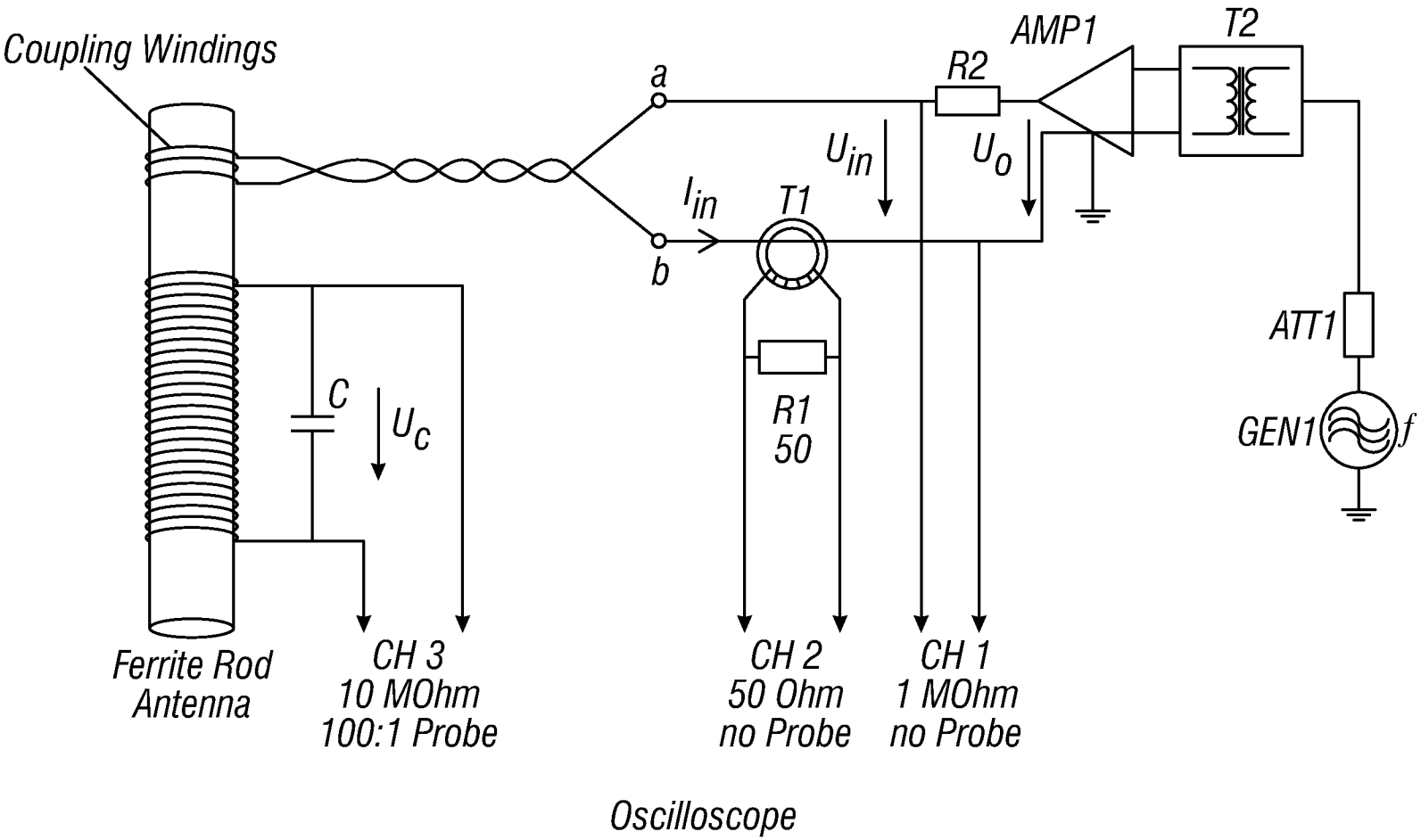
FIG. 2 shows a measurement set up.

FIG. 2 illustrates the ways of measuring the different values, shown as channel 1, channel 2 and channel 3. These different values can be measured as follows:

Oscilloscope: measures r.m.s. of $U_{in}$ (CH1), $I_{in}$ (CH2), $U_C$ (CH3)

The remaining values are calculated.

Table 1 represents the results for an "X" antenna made using ferrite materials. The measured values are used to calculate certain other values within this antenna.

Figure 3:
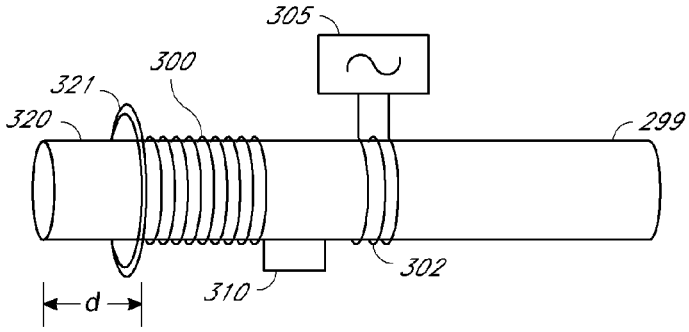
FIG. 3 shows a first ferrite rod antenna with partial coils.

This antenna shown in FIG. 3 has a length of 87 mm, and a diameter of 10 mm. The ferrite material used is Ferroxcube 4B2. The main coil of this antenna has 19 windings of main coil 300 for a total length of 20 mm of 300×0.4 mm wire. A three turn coupling coil 302 is connected to receive the magnetic resonant field from a generator 305. The coupling coil 302 is spaced along the rod at 12 mm from the end of the main coil. A 55.17 nF 500V Mica capacitor 310 is used to form resonance.

A number of measurements were carried out as shown in Table 1, where the left side of the table represents the inputs to the coil. Based on these inputs, and the equations noted above, the values on the right side of the table were calculated.

TABLE 1

| | Input (measured) | | | | Calculation | | |
|---|---|---|---|---|---|---|---|
| Meas # | f res kHz | U in V rms | I in mA rms | Uc V rms | P in mW | Z in Ohm | L µH |
| 8 | 134.98 | 0.00818 | 0.1406 | 0.0888 | 0.0012 | 58.179 | 25.200 |
| 7 | 134.97 | 0.0259 | 0.511 | 0.284 | 0.0132 | 50.685 | 25.204 |
| 6 | 134.9 | 0.0784 | 1.67 | 0.861 | 0.131 | 46.946 | 25.230 |
| 1 | 134.920 | 0.075 | 1.450 | 0.733 | 0.109 | 51.724 | 25.222 |
| 2 | 134.752 | 0.228 | 5.270 | 2.260 | 1.202 | 43.264 | 25.285 |
| 3 | 134.294 | 0.643 | 18.440 | 6.370 | 11.857 | 34.870 | 25.458 |
| 4 | 133.113 | 1.555 | 68.070 | 17.140 | 105.849 | 22.844 | 25.912 |
| 5 | 131.011 | 3.450 | 244.400 | 37.050 | 843.180 | 14.116 | 26.750 |

| | Calculation | | | | | | |
|---|---|---|---|---|---|---|---|
| Meas # | X Ohm | Q UL U | I A mA rms | R s Ohm | µ rod U | B rod mT peak | R p Ohm |
| 8 | 21.372 | 320.804 | 4.155 | 0.0666 | 12.632 | 0.099 | 6856.3 |
| 7 | 21.374 | 285.126 | 13.287 | 0.0750 | 12.633 | 0.318 | 6094.2 |
| 6 | 21.385 | 264.770 | 40.262 | 0.0808 | 12.647 | 0.963 | 5662.1 |
| 1 | 21.382 | 231.067 | 34.282 | 0.0925 | 12.643 | 0.820 | 4940.6 |
| 2 | 21.408 | 198.559 | 105.567 | 0.1078 | 12.674 | 2.531 | 4250.8 |
| 3 | 21.481 | 159.311 | 296.537 | 0.1348 | 12.761 | 7.159 | 3422.2 |
| 4 | 21.672 | 128.067 | 790.886 | 0.1692 | 12.988 | 19.434 | 2775.5 |
| 5 | 22.020 | 73.934 | 1682.592 | 0.2978 | 13.408 | 42.683 | 1628.0 |

T1: Current transformer, toroid Epcos R16/T38, 25 turns

R1: Load resistor of T1(R1//R(CH2)=25 . . . 100 Ohm, 25 Ohm: 1 A current→1V at CH2)

AMP1: Amplifier arcus 100 W, voltage gain=33 (135 kHz)

R2: Load resistor of AMP1, 5 . . . 50 Ohm (needed for safety and stability of the amplifier)

T2: Isolation transformer 1:1 (2*40 turns bifilar, Epcos R16/T38 toroid) to prevent from ground loop interference ATT1: Attenuator 50 Ohm, 10 . . . 20 dB to prevent from overload of AMP1

GEN1: RF signal generator (Rohde&Schwarz SMG)

According to a measurement procedure, the generator is started with −10 DBM of power, and at a frequency that is resonant to the calculated resonant frequency from the equation 2.1. At this resonant frequency, all of the signals $U_{in}$, $I_{in}$ and $U_c$ are in phase so long as the polarities of channel 1 and Channel I mean channel 2 and Channel 3 is correct and the current channel (Ch2) has a minimum value.

The values of $U_{in}$, $I_{in}$ and $U_c$ are measured at the resonant frequency.

The table shows that the Q value stays greater than 100 up to a power level of approximately 100 mw. The 840 mw measurement showed a Q of 73, and a resonant frequency that has shifted by almost 4 Khz from the value it shows at $10^{-3}$ mw.

According to one embodiment, therefore, the antenna is only operated in regions where it has specific values that are within the desired values of operation of the antenna, e.g, high enough Q, proper frequency, etc.

Figure 4:
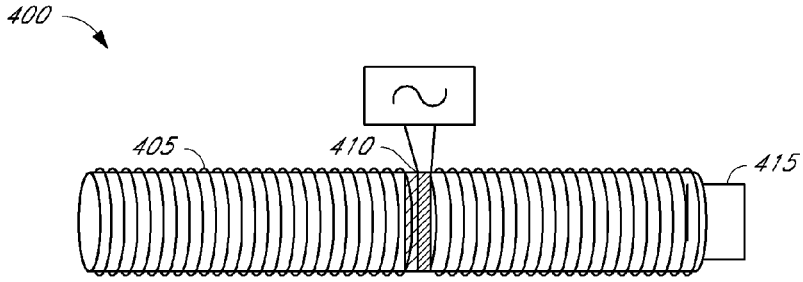
FIG. 4 shows a second ferrite rod with a complete coil.

A second embodiment used an antenna as shown in FIG. 4. This used a similar sized rod formed of similar material. Antenna 400 uses 75 turns of wire 405 and a two-turn coupling coil 410, located over the main coil, at 25 mm from the end of the main coil. This antenna uses a 6.878 nF 400 V polypropylene capacitor 415.

Table 2 represents second measured and calculated results for the FIG. 4 antenna.

TABLE 2

| | Input (measured) | | | | Calculation | | | | | | | | | |
|---|---|---|---|---|---|---|---|---|---|---|---|---|---|---|
| Meas # | f res kHz | U in V rms | I in mA rms | Uc V rms | P in mW | Z in Ohm | L µH | X Ohm | Q UL U | I A mA rms | R s Ohm | µ rod U | B rod mT peak | R p Ohm |
| 1 | 133.601 | 0.0274 | 0.38 | 0.895 | 0.0104 | 72.105 | 206.328 | 173.200 | 444.185 | 5.187 | 0.3889 | 23.235 | 0.258 | 76932.9 |
| 2 | 133.541 | 0.0828 | 1.265 | 2.684 | 0.1047 | 65.455 | 206.514 | 173.278 | 396.918 | 15.490 | 0.4366 | 23.256 | 0.768 | 68777.1 |
| 3 | 133.333 | 0.2336 | 4.462 | 7.68 | 1.042 | 52.353 | 207.159 | 173.548 | 326.062 | 44.253 | 0.5323 | 23.329 | 2.201 | 58587.4 |
| 4 | 132.763 | 0.610 | 17.240 | 19.710 | 10.518 | 35.389 | 208.941 | 174.293 | 211.911 | 113.085 | 0.8225 | 23.529 | 5.673 | 36934.7 |
| 5 | 131.504 | 1.404 | 65.100 | 45.860 | 91.400 | 21.567 | 212.961 | 175.962 | 130.768 | 260.624 | 1.3456 | 23.982 | 13.325 | 23010.2 |
| 6 | 129.342 | 2.882 | 247.000 | 94.650 | 711.854 | 11.668 | 220.140 | 178.903 | 70.345 | 529.057 | 2.5432 | 24.791 | 27.962 | 12584.9 |
| 7 | 127.234 | 4.720 | 652.000 | 149.200 | 3077.440 | 7.239 | 227.495 | 181.867 | 39.773 | 820.378 | 4.5726 | 25.619 | 44.807 | 7233.5 |

This embodiment shows a Q of 70 at 700 me, and a Q of 40 at 3 watts.

Figure 5:
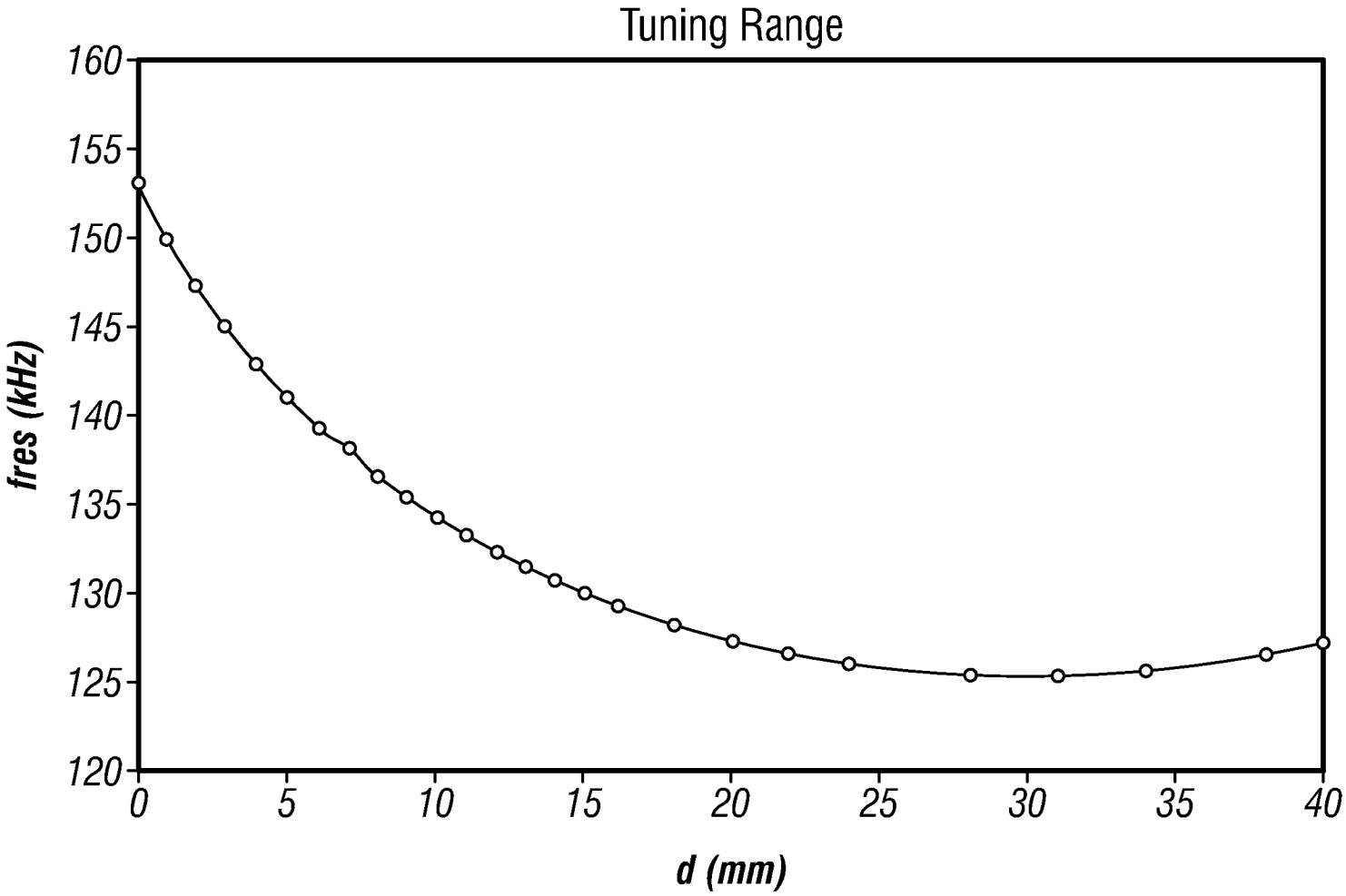
FIG. 5 shows a plot of resonance frequency.

According to one embodiment, a tunable ferrite Rod antenna is formed. In the embodiment of FIG. 3, the Rod 299 is formed with the coil 300 thereon. The coil is in series with a capacitor 310, which is coupled to the coil. In one embodiment, a spring retainer 320 is formed that holds the coil into place. The spring retainer 310 holds the position of the coil using, for example, a clampable portion 321, for example, a set screw. The distance d between the edge of the coil and the end of the ferrite can be varied by the moving the coil. Moreover, the resonance frequency of the coil changes depending on this movement. Based on an analysis, FIG. 5 shows an expected resonance frequency versus coil position for the antenna of FIG. 3.

Based on the analysis above, Q factors as high as 100 may be achievable at low frequency values (for example 135 kHz) and values up to 500 mW. While there is some detuning due to the nonlinear effects of the ferrite material, this detuning may be compensated using a tuning mechanism. A sliding coil is described herein which can be used as the tuning mechanism.

Figure 6:
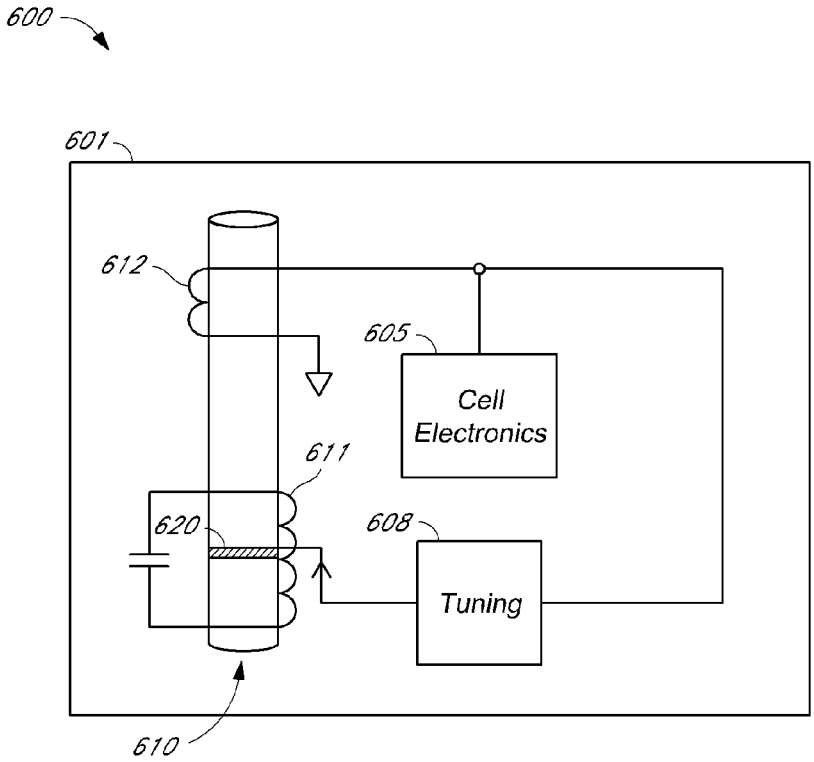
FIG. 6 shows a block diagram of the rod antenna in use.

Another embodiment shown in FIG. 6 uses this system in a cellular phone embodiment. FIG. 6 illustrates the cellular handset 600, mounted with a housing 601. A ferrite Rod antenna 610 is mounted within the cellular handset. The antenna has a main coil part 611 in parallel with a capacitor, and a smaller coupling coil 612. The ferrite Rod antenna 610 includes a movable tuning part 620.

The cellular phone may also include cellular electronics shown as 605. A tuning part 608 detects characteristics of transmit and receive, and also measures resonant frequency and Q value of the antenna 610. The antenna 610 has a movable tuning part 620 which may be a mechanical tuning part as in the FIG. 3 embodiment, or may be an electronic tuning part, e.g., an electronically variable capacitor connected to the antenna 610. An output from the tuning part 608 is used to change the tuning of the antenna. In one embodiment, the adjustment is automatically made based on the amount of power being received by the phone over the wireless link. In another embodiment, the tuning part is adjusted such that the antenna 610 receives a maximum amount of the magnetic flux in the area of the electronics.

One advantage of using a properly tuned ferrite antenna is that the ferrite material in essence pulls out the magnetic flux, thereby producing an area where the magnetic flux is depleted. Since the magnetic flux is depleted in the area inside the housing, this may reduce any effect of this magnetic flux on the remaining portions of the phone. That is, by better tuning the ferrite antenna, less magnetic flux may eventually interact with the circuitry within the phone because more of that flux is absorbed by the antenna.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other sizes, materials and connections can be used. Other structures can be used to receive the magnetic field. In general, an electric field can be used in place of the magnetic field, as the primary coupling mechanism. Other kinds of antennas can be used. The above has described how the antenna is cylindrical and wound on a cylindrical rod; however the base can be any other shape. Other materials and coil factors can be used.

Also, the inventors intend that only those claims which use the-words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

What is claimed is:

1. A method of receiving power via a wireless field with a ferrite antenna, the ferrite antenna including a ferrite rod, a first coil, and a second coil physically unconnected to the first coil, the method comprising:

receiving power via the wireless field with the first coil;

transferring the received power through the ferrite rod;

moving a position of at least one of the first coil and the second coil with respect to the ferrite rod so as to tune the ferrite antenna;

receiving, at the second coil, the transferred power; and powering a device using the power received at the second coil.

2. The method of claim 1, wherein the tuning the ferrite antenna is based on characteristics of reception.

3. The method of claim 2, wherein said characteristics include an amount of power received by said device.

4. The method of claim 2, wherein said tuning comprises changing a Q value of said first coil portion on said ferrite antenna.

5. The method of claim 2, wherein said tuning comprises changing a resonant frequency value of said first coil.

6. The method of claim 2, wherein said tuning comprises changing a characteristic of the ferrite antenna to absorb a maximum amount of magnetic flux within a housing of an electronic device.

7. The method of claim 2, wherein said device is a portable electronic device.

8. The method of claim 1, wherein the first coil is connected with a capacitor to form an LC resonant circuit that is resonant with an applied driving signal.

9. A device for wireless power transfer, comprising:

a housing;

a ferrite antenna, supported by said housing, said ferrite antenna comprising a ferrite rod, a first coil connected to a capacitor, and a second coil physically unconnected to said first coil, a position of at least one of said first coil and said second coil being adjustable with respect to said ferrite rod; and a circuit coupled to said second coil and configured to receive power from said second coil, and configured to transfer said received power to a device within said housing.

10. The device of claim 9, wherein said ferrite antenna is a ferrite rod, extending across an area of said housing.

11. The device of claim 9, further comprising a tuning element configured to tune said first coil, said tuning element further configured to change at least one parameter of said first coil according to an amount of power reception.

12. The device of claim 11, wherein said tuning element is configured to change a resonant frequency of said first coil.

13. The device of claim 12, wherein said tuning element is configured to change a Q value of said first coil.

14. The device of claim 12, wherein said tuning element is controlled according to a parameter of operation of said powered device, and wherein the tuning element is configured to automatically tune the ferrite antenna based on the parameter of operation.

15. The device of claim 12, wherein said tuning element is controllable to minimize a magnetic flux within the housing.

16. The device of claim 9, wherein the first coil is connected with the capacitor to form an LC resonant circuit that is resonant with an applied driving signal.

17. A device for wireless power transfer, comprising:

means for receiving power via a wireless field, the means for receiving power electrically coupled to a ferrite rod;

means for adjusting power reception, the means for adjusting power reception comprising means for moving a position of at least the means for receiving, the position of at least the means for receiving being adjustable with respect to the ferrite rod; and means for transferring the received power to an electronic device, the means for transferring the received power being electrically coupled to the ferrite rod and physically unconnected to the means for receiving power via the wireless field.

18. The device of claim 17, wherein the means for receiving power via the wireless field comprises a first coil and the means for transferring the received power to the device comprises a second coil.

19. The device of claim 18, wherein the first coil is connected with a capacitor to form an LC resonant circuit that is resonant with an applied driving signal.

20. The device of claim 17, wherein said device is a portable electronic device.

21. The device of claim 17, further comprising means for tuning the means for receiving power via the wireless field.

22. A device for wireless power transfer, comprising:

a housing;

a ferrite antenna, supported by said housing, said ferrite antenna comprising a first coil and a second coil, said first coil being connected to a capacitor, and a position of at least one of said first coil and said second coil being adjustable with respect to said ferrite antenna;

a tuning circuit coupled to said first coil and said second coil, said first coil connected to said second coil through said tuning circuit; and a receiving circuit coupled to said second coil and configured to receive power from said second coil, and to transfer said received power to a device within said housing.

23. The device of claim 22, wherein the first coil and the second coil are directly connected to the tuning circuit.

24. The device of claim 22, wherein the first coil is connected to the second coil only through the tuning circuit.

25. The device of claim 22, wherein the tuning circuit is configured to tune the ferrite antenna based on power received by the receiving circuit.

26. A method of receiving power via a wireless field with a ferrite antenna, the ferrite antenna including a ferrite rod, a first coil, a second coil, and a tuning circuit coupled to the first coil and the second coil, the method comprising:

receiving power via the wireless field with the first coil;

transferring the received power through the ferrite rod;

receiving, at the second coil, the transferred power;

powering a device using the power received at the second coil; and tuning the ferrite antenna based on a power received by the device.

27. The method of claim 26, wherein the first coil and the second coil are directly connected to the tuning circuit.

28. A device including a ferrite antenna, the device comprising:

means for receiving power via a wireless field, the means for receiving power electrically coupled to a ferrite rod;

means for transferring the received power to an electronic device, the means for transferring the received power being electrically coupled to the ferrite rod; and means for tuning the ferrite antenna based on power received by the electronic device.

29. The device of claim 28, wherein the means for receiving power via the wireless field comprises a first coil, the means for transferring the received power to the device comprises a second coil, and the means for tuning the ferrite antenna comprises a tuning circuit.

* * * * *

UNITED STATES PATENT AND TRADEMARK OFFICE

CERTIFICATE OF CORRECTION

PATENT NO. : 8,487,479 B2
APPLICATION NO. : 12/391054
DATED : July 16, 2013
INVENTOR(S) : Cook et al.

It is certified that error appears in the above-identified patent and that said Letters Patent is hereby corrected as shown below:

In the Specification

Column 5 line 50, Change "1 A" to --1A--.

Column 6 line 51, Change "Khz" to --kHz--.

Column 7 line 15, Change "me" to --mw--.

Column 8 line 28, Change "rod;" to --rod,--.

Signed and Sealed this
Twenty-third Day of September, 2014

Michelle K. Lee

Michelle K. Lee
*Deputy Director of the United States Patent and Trademark Office*